United States Patent [19]

Gasque, Jr.

[11] Patent Number: 4,723,128

[45] Date of Patent: Feb. 2, 1988

[54] ROOF MOUNT FOR DISH ANTENNA

[76] Inventor: Samuel N. Gasque, Jr., 600 E. Harrison St., Dillon, S.C. 29536

[21] Appl. No.: 903,515

[22] Filed: Sep. 4, 1986

[51] Int. Cl.[4] ..... H01Q 1/08

[52] U.S. Cl. ..... 343/880; 343/878; 343/885; 343/890; 343/892

[58] Field of Search ..... 343/878, 880, 885, 890, 343/892

[56] References Cited

U.S. PATENT DOCUMENTS

| | | | |
|---|---|---|---|
| 2,248,335 | 7/1941 | Burkhart | 343/890 |
| 2,572,430 | 10/1951 | Balton | 343/880 |
| 2,895,752 | 7/1959 | De Barrie | 343/880 |
| 3,084,769 | 4/1963 | Collier | 343/890 |
| 3,094,303 | 6/1963 | Belger | 343/880 |
| 3,560,987 | 2/1971 | Lockwood | 343/880 |

FOREIGN PATENT DOCUMENTS

| | | | |
|---|---|---|---|
| 96959 | 12/1983 | European Pat. Off. | 343/880 |
| 1149432 | 12/1957 | France | 343/880 |
| 2021868 | 12/1979 | United Kingdom | 343/880 |

*Primary Examiner*—William L. Sikes
*Assistant Examiner*—Robert E. Wise
*Attorney, Agent, or Firm*—Clifton Ted Hunt

[57] ABSTRACT

A roof mount for securely attaching dish antennae to roofs of houses typically supported by a plurality of spaced rafters has a two piece frame attached to a selected portion of a roof with one piece on top of the roof supporting the dish and its adjusting mechanism and the other piece of the frame underlying the first frame beneath the roof. A plurality of fasteners penetrate the roof and both frames and draw the frames toward each other to clamp them about the selected portion of the roof and provide steady support for the antenna.

9 Claims, 5 Drawing Figures

ROOF MOUNT FOR DISH ANTENNA

FIELD OF THE INVENTION

This invention relates to a roof mount for parabolic dish antennae specifically oriented to receive signals transmitted by satellites in geostationary orbit about the earth.

BACKGROUND OF THE INVENTION

Television signals transmitted by geostationary satellites are generally received on the ground by parabolic dish antennae. The strength of the signal being transmitted determines the size or diameter of the dish required for reception. Weaker signals require larger dishes. Many signals require a dish having a diameter of three meters or more for proper reception.

It is anticipated, however, that the strength of the signal will be increasingly stronger as more satellites are put into orbit, thereby reducing the size of the dish required for good reception. The smaller dishes will probably cost less than the relatively larger dishes generally in use today, and it is anticipated that the reduced cost and size of parabolic dish antennae will increase the popularity of these antennae among homeowners, many of whom will probably want to mount their dish antenna on the roof of their home. The structure for mounting dish antennae on the roofs of dwellings has to be capable of supporting the dish on a variety of rooftops of varying shapes and slopes in a fixed, unvarying preselected attitude because proper reception requires that the dish accurately maintain its preset alignment with the transmitting satellite.

U.S. Pat. No. 4,510,502 issued Apr. 9, 1985 to Lyle W. Hovland for DISH ANTENNAE MOUNTING STRUCTURE discloses a roof mount with angularly adjustable components specifically intended for use in mounting dish antennae on a variety of rooftops of varying slopes, but the mounting structure of Hovland is attached by bolts to individual rafters spaced from each other beneath the roof. This type of attachment to the roof may be unsteady in high winds and is objectionable because it depends for support on a relatively small area of the portion of the roof it spans.

U.S. Pat. No. 3,094,303 issued June 18, 1963 to Myron P. Belger for ANTENNA SUPPORTING BRACKETS shows a mount for a television antenna which clamps over the eave of a roof to avoid drilling holes in the roof. Belger's roof mount is not intended for use with dish antennae and the single bolt used to tighten the clamp would be insufficient to provide the steady support required for dish antennae.

SUMMARY OF THE INVENTION

The present invention provides a strong lightweight mounting structure for a dish antenna which rigidly and securely fixes the antenna to a roof supported by rafters at any angle and of the type generally found on residential houses and apartments.

The mounting structure includes an upstanding post on which the dish is mounted and a framework for adjusting the mounting post to a selected position and steadily supporting it in the selected position. The frame structure of this invention is specifically designed to maintain the preset alignment of the dish with the transmitting satellite in winds approaching hurricane force.

The framing structure of this invention literally incorporates the dish antenna into a selected portion of a roof made of typical roofing materials and supported by typically spaced rafters. A first frame, preferably in the shape of an equilateral triangle, is positioned on the outside of the selected portion of the roof and includes adjusting mechanism for orienting and supporting the antenna to receive the signal from a satellite. A second complementary frame underlies the first frame beneath the selected portion of the roof with the legs of the second frame extending across and bearing against the several rafters supporting the selected portion of the roof. The first and second frames are connected by bolts extending through the roof and joining the two frames together. The frames extend across and sandwich between them a minimum of 25 square feet (2.32 square meters) of roof and extend transversly across at least three rafters. The roof mount becomes, in effect, a part of the roof and steadily supports the antenna in its adjusted position against force that does not move the roof.

The first frame that contains the adjusting mechanisms for supporting the dish antenna can be used without the second frame as a temporary set-up on the ground.

DETAILED DESCRIPTION OF THE INVENTION

Figures 1, 2, 3, 4, 5:
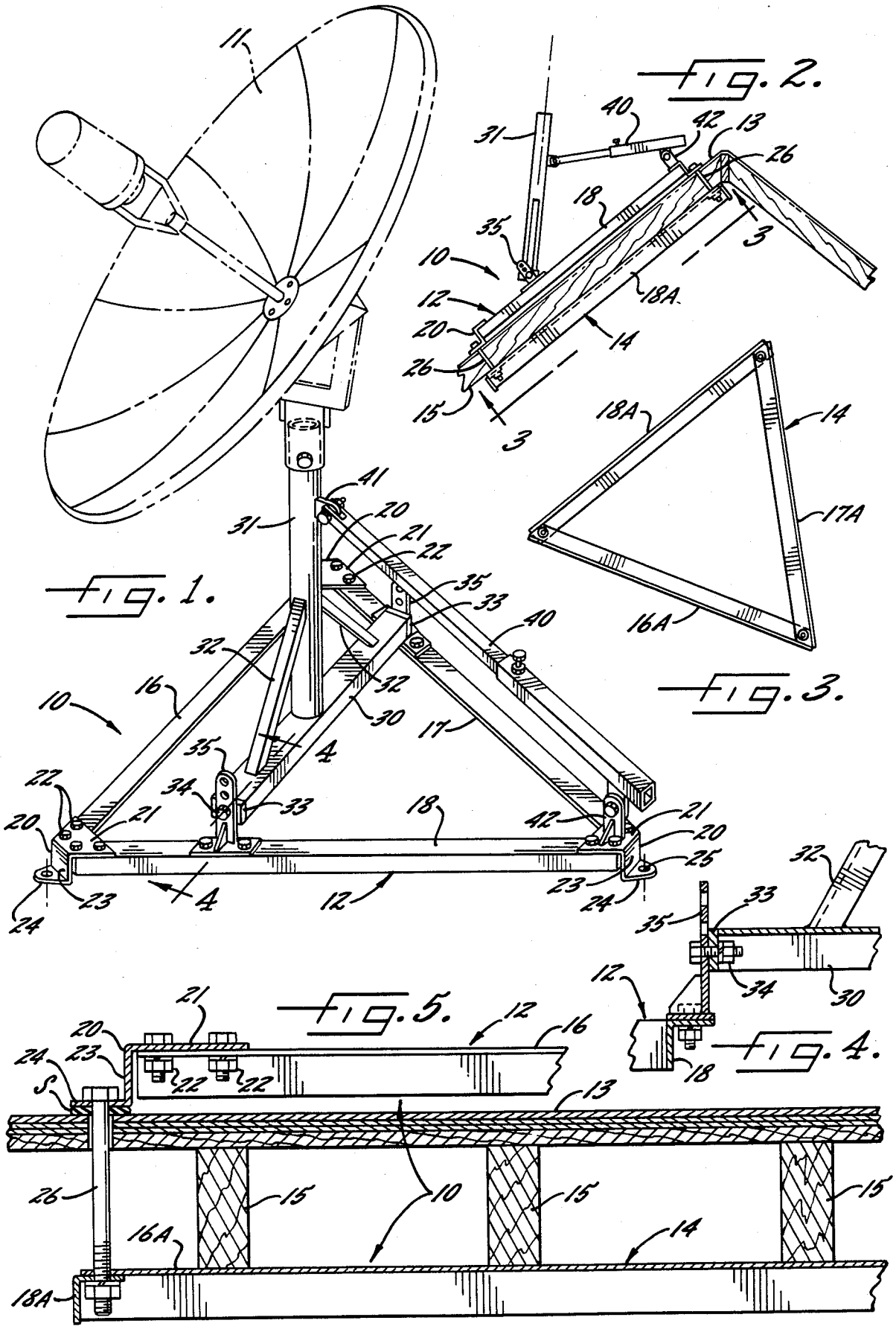
FIG. 1 is a perspective view showing a dish antenna in phantom lines adjustably mounted on a support frame.
FIG. 2 is a somewhat schematic sectional view showing the support frame illustrated in FIG. 1 mounted on a selected portion of a roof with a complementary anchor frame seated against rafters beneath the roof and bolted to the support frame.
FIG. 3 is a sectional view taken substantially along the line 3—3 in FIG. 2.
FIG. 4 is a sectional view taken substantially along the line 4—4 in FIG. 1.
FIG. 5 is a fragmentary transverse sectional view, with parts broken away, illustrating the roof mount shown in FIG. 2.

Referring more specifically to the drawings, the numeral 10 broadly designates a roof mount for a dish antenna 11. The roof mount 10 comprises a triangularly shaped support frame broadly indicated at 12 intended to be positioned on a selected portion of a roof 13 and bolted to a triangularly shaped anchor frame 14 complementary to the support frame 12 and seated against the underside of several rafters 15 beneath the selected portion of roof 13. The rafters are typically spaced apart about 16 inches (103.23 cm).

The triangular support frame 12 comprises legs 16, 17, and 18. Each of these legs is a minimum of about 5 feet long and of sufficient length to extend transversly across at least three rafters. The legs 16, 17, and 18 are shown to be formed of angle iron, but they can be of a longer length and formed from any material having the requisite strength to maintain the antennna in its selected orientation.

The legs 16, 17, and 18 are interconnected at their junctures by mounting flanges 20. The mounting flanges 20 each include a flat upper plate 21 spanning the juncture of adjoining legs and connected to the legs by bolts 22. Each mounting flange extends downwardly as at 23 over the ends of adjoining legs and terminates in an outwardly extending lug 24 parallel with the plate 21. Each lug 24 has a bore 25 therethrough to receive an enlongated bolt 26.

A crossbar 30 which may be formed of square steel tubing extends between the legs 17 and 18 of the support frame 12 to support a post 31 and the dish antenna 11. The post 31 is braced by angular struts 32 between the post and crossbar 30.

The crossbar 30 is fitted with a cap 33 at each end to receive bolts 34 which pivotally mount the crossbar at a selected elevation in brackets 35 rising from the legs 17 and 18 at points spaced about 25% of the distance between the leg 16 and the juncture of the legs 17 and 18.

A telescopic rod 40 is pivotally connected at its outer end to the post 31 at a point 41 preferably about 20% of the distance from the top of the post to the crossbar 30. The inner-end of telescopic rod 40 is pivotally connected to a bracket 42 rising from the plate 21 on top of the mounting flange 20 at the juncture of legs 17 and 18. The angularity of the post 31 is adjusteable by manipulating the telescopic rod 40.

The anchor frame 14 corresponds to the support frame 12 in shape and dimension and is composed of legs 16*a*, 17*a*, and 18*a* formed from angle iron and welded together to underlie the legs 16, 17, and 18 on the support frame 12 when the roof mount 10 is assembled. The anchor frame 14 has threaded bores at the junctures of the legs 16*a*, 17*a*, and 18*a* to receive the bolts 26.

The bolts 26 extend through the bores 25 in support frame 12, through a seal S (to prevent leakage), and into the threaded bores in the anchor frame. The bolts are tightened to draw the anchor frame upwardly against the rafters beneath the selected portion of the roof 13 and clamp that portion of the roof between the support frame 12 and the anchor frame 14.

With about 25 square feet of the roof tightly clamped between the support frame and the anchor frame, the post 31 is then firmly anchored at a selected angle to steadily hold the dish antenna 11 at the desired orientation for proper reception of the satellite signal at all times.

It is recognized that larger frames may be required for installations in geographical areas subject to strong winds and/or to support large dishes. Additional bolts should be used on frames having legs longer than five feet so that there is a bolt connecting the two frames at least every five feet.

There is thus provided an effective roof mount for a dish antenna which is effective, inexpensive, and easy to install.

Although specific terms have been used in describing the invention, they are used in their generic sense only and not for purposes of limitation.

I claim:

1. A roof mount for supporting a dish antenna on a roof made of conventional roofing materials and supported by conventional rafters spaced from each other beneath the roof, said roof mount comprising a support frame positioned in use on the outer surface of the roof and extending across a selected portion of the roof overlying a plurality of rafters beneath the roof, an anchor frame positioned in use against the inner surfaces of said plurality of rafters beneath the selected portion of the roof, means connecting the support frame to the anchor frame in binding relation to the selected portion of the roof, and means connecting the dish antenna to the support frame.

2. A roof mount according to claim 1 wherein the means connecting the support frame to the anchor frame comprises fasteners extending through the support frame, the roof and the anchor frame and drawing the support frame and the anchor frame into binding relation with the selected portion of the roof.

3. A roof mount according to claim 2 wherein the fasteners are threaded bolts and nuts.

4. A roof mount according to claim 2 wherein the support frame and anchor frame are of corresponding triangular configuration and wherein the means connecting the support frame to the anchor frame comprises fasteners extending through the roof between corresponding corners of the support frame and anchor frame.

5. A roof mount according to claim 4 wherein the triangluarly shaped support and anchor frames each include three interconnected legs extending across and binding the selected portion of the roof between them.

6. A roof mount according to claim 5 which includes a mounting flange connecting the adjoining legs of the support frame.

7. A roof mount according to claim 6 wherein the mounting flanges each include a lug having an aperture to receive a bolt extending through the lug, the roof, and into the anchor frame.

8. A roof mount according to claim 1 wherein the means connecting the dish antenna to the support frame comprises a crossbeam extending between adjoining legs of the support frame, a post rising from the crossbeam and fixed thereto, and means connecting the dish antenna to the post.

9. A roof mount according to claim 8 wherein the cross beam is pivotally connected to the support frame, and a telescopic rod extends between the post and the support frame.

* * * * *